US009222283B1

(12) United States Patent
Zhang et al.

(10) Patent No.: US 9,222,283 B1
(45) Date of Patent: Dec. 29, 2015

(54) COMBINATION LOCK WITH OVERRIDE KEY

(71) Applicant: Digilock Asia Ltd., Kowloon (HK)

(72) Inventors: An Zhang, Shaoguan (CN); Asil T. Gokcebay, Petaluma, CA (US)

(73) Assignee: Digilock Asia Ltd., Kowloon (HK)

( * ) Notice: Subject to any disclaimer, the term of this patent is extended or adjusted under 35 U.S.C. 154(b) by 0 days.

(21) Appl. No.: 14/663,386

(22) Filed: Mar. 19, 2015

(51) Int. Cl.
*E05B 37/02* (2006.01)
*E05B 37/00* (2006.01)

(52) U.S. Cl.
CPC ..... *E05B 37/0034* (2013.01); *Y10T 70/415* (2015.04); *Y10T 70/7141* (2015.04); *Y10T 70/7147* (2015.04); *Y10T 70/765* (2015.04); *Y10T 70/7638* (2015.04); *Y10T 70/7644* (2015.04)

(58) Field of Classification Search
CPC . E05B 37/02; E05B 37/0034; E05B 37/0031; E05B 37/0037; E05B 37/0041; E05B 9/084; E05B 9/086; E05B 13/103; E05B 13/106; E05B 13/108; E05B 13/004; Y10T 70/415; Y10T 70/7141; Y10T 70/7147; Y10T 70/7638; Y10T 70/7644; Y10T 70/765
USPC ..... 70/21, 284, 285, 375, 367–371, 204, 70/207, 210, 213–221, 224, DIG. 31, 70/DIG. 39, DIG. 44, DIG. 63, DIG. 71
See application file for complete search history.

(56) References Cited

U.S. PATENT DOCUMENTS

| | | | | | |
|---|---|---|---|---|---|
| 4,712,400 | A * | 12/1987 | Steinbach | 70/369 |
| 5,235,832 | A * | 8/1993 | Lux et al. | 70/368 |
| 6,155,090 | A * | 12/2000 | Rubensson | 70/367 |
| 6,508,089 | B1 * | 1/2003 | Tsai | 70/213 |
| 6,513,356 | B1 * | 2/2003 | Yang | 70/213 |
| 6,598,434 | B2 * | 7/2003 | Yang | 70/213 |
| 7,444,844 | B1 * | 11/2008 | Lee | 70/21 |
| 7,958,757 | B1 * | 6/2011 | Lee | 70/21 |
| 8,087,274 | B2 * | 1/2012 | Yu et al. | 70/284 |
| 8,091,391 | B2 * | 1/2012 | Yu et al. | 70/21 |
| 8,234,891 | B2 * | 8/2012 | Dalton et al. | 70/21 |
| 8,316,675 | B2 * | 11/2012 | Yang | 70/285 |
| 2003/0089147 | A1 * | 5/2003 | Yang | 70/284 |
| 2004/0011098 | A1 * | 1/2004 | Yang | 70/284 |
| 2006/0248932 | A1 * | 11/2006 | Yang | 70/284 |
| 2007/0144226 | A1 * | 6/2007 | Miao | 70/214 |
| 2009/0301147 | A1 * | 12/2009 | Yang | 70/284 |
| 2011/0083483 | A1 * | 4/2011 | Yang | 70/284 |

* cited by examiner

*Primary Examiner* — Lloyd Gall
(74) *Attorney, Agent, or Firm* — Thomas M. Freiburger

(57) ABSTRACT

A combination lock, such as a dial combination cam lock, has a mechanical key override, the mechanical key extending through the manual knob of the cam lock. For a lost mechanical key situation, or to change the mechanical key, a special key or device can be inserted to enable the knob and key core or plug to be rotated to a further position not normally available. In this position the key, knob and core can be removed, then replaced with a different key and core, preferably using the same knob.

4 Claims, 9 Drawing Sheets

FIG. 9A
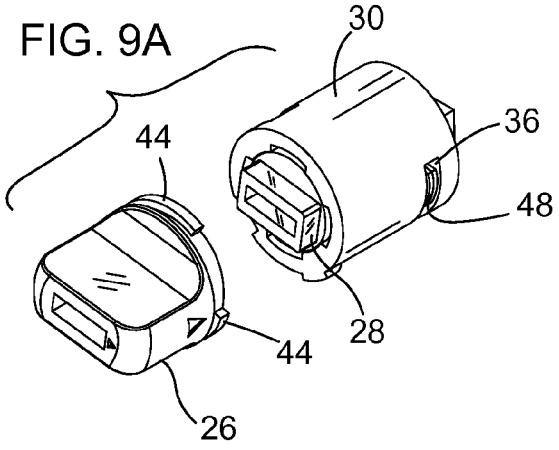
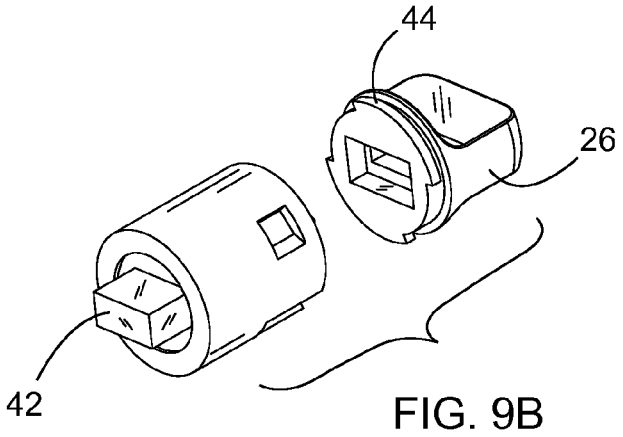
FIG. 9B

COMBINATION LOCK WITH OVERRIDE KEY

BACKGROUND OF THE INVENTION

This invention concerns locks, particularly cam locks as used on interior doors, panels, etc., including lockers for temporary use. The invention particularly relates to a mechanical combination lock that has an override mechanical key access, in a cam lock configuration.

Combination locks have been in several different styles, including those with a rotary dial and a combination consisting of a sequence of numbers that are entered after alternate rotations of the dial, such as right-left-right. Other combination locks have three or four or five rotatable dials, for example, which are turned by the user to set each at a particular digit to achieve access. Other forms of mechanical combination locks are also known.

Some of the locks can be used in a shared use application wherein the user sets a code to lock the door and scrambles the numbers and when he or she return sets the same code to unlock. In other applications the lock is used in an assigned mode wherein the user sets the correct code which is already set in the lock previously to open the lock.

These combination locks, including in the cam lock configuration, have sometimes included an override mechanical key access feature. In some cases the mechanical key cylinder with key slot has been located to extend through the knob or handle which the user ordinarily turns to release the cam lock after entering the necessary combination. In some cases the mechanical key cylinder is in the center of the knob and the knob simply wraps around the key slot. In other cases the knob covers the entire mechanical cylinder with the exception of the slot in the center for the insertion of the key. In this case the knob hides the key cylinder under the knob, and the key is inserted through the knob and into the cylinder.

The mechanical key would be held by a manager of a locker room in a gym facility or employer locker area, etc. Typically, manufacturers of such locks have provided only a few different key cut combinations for the mechanical override key for their various customers. Some manufacturers have produced only four different override key combinations; thus, a thief gaining access to a manager's override key would have a good chance of being able to open any locker in a different facility using the override key on locks from the same manufacturer.

Another problem with the typical combination lock/mechanical key override was that if the manager's override key was lost (or stolen), the lock would have to be dismantled in order to be re-keyed, which is costly and would have to be done on every lock.

There has been a need for a better, more conveniently and efficiently re-keyable mechanical override on a mechanical combination lock, particularly a cam lock.

SUMMARY OF THE INVENTION

The invention addresses this need with a combination lock, such as a dial combination cam lock, with a mechanical key override that has a removable core, but with the removable core covered by the knob.

In the event the regular override mechanical key is lost or stolen, or is desired to be changed, a special key or device can be inserted into the lock, through the knob or handle, that will enable the lock's knob and key core or plug to be removed. Preferably using the same knob, this knob can be attached to a replacement key core, fitted to another override key, and inserted into the lock to replace the core for which the key has been lost. All key cores in the facility can easily be replaced in this way, easily and efficiently. The removable core cylinder has existed in mechanical locks, mechanical cam locks as well as mechanical combination locks. The core is removed by a special removal key which removes the core and replaces the core with a new one. It has not been possible to utilize the removable core cylinder in a combination lock wherein the knob covers the entire cylinder.

The invention can be carried out in several different ways. In one preferred embodiment, the special removal key, inserted through the same slot as would be the override key, is of greater length than the override key and is effective to pull in a pin or wafer that ordinarily remains in an extended position from the core so as to retain the core in place against removal. The special key then turns the handle and core to a rotational position beyond the normal "lock" and "unlock" positions, allowing the core and handle/knob to be removed with the special removal key. In another embodiment, the special, specifically-designed tool is provided for inserting into the lock in a way that will release the core and allow it to be pulled out. In either event, the new core is easily and conveniently inserted into the lock of the invention, thus re-keying the mechanical override of the lock.

The invention adds value to the combination lock with a mechanical override, in that a simple replacement can be made for the override without having to dismantle the lock, which in many cases would be better accomplished by simply replacing the entire lock.

Removable core locks have been known prior to this invention, but not in the mechanical override of a mechanical combination cam lock with the knob over the cylinder. No cam lock knob is known previously to have been removable for this purpose.

The term cam lock is used herein in its typical industry sense, meaning a cabinet or locker lock not on or suitable for an entry door, and having a rotatable cam or tab at rear that engages with some interior structure of a cabinet to lock the door or panel of the cabinet.

It is therefore an object of the invention to improve on mechanical combination cam locks by providing an override mechanical key which operates through the manual handle of the cam lock and makes the core very easily removable and replaceable with a special removal key or other special device, with the knob reusable. These and other objects, advantages and features of the invention will be apparent from the following description of a preferred embodiment, considered along with the accompanying drawings.

DESCRIPTION OF THE DRAWINGS

FIGS. 9A and 9B are perspective views showing the knob or handle, core and a cylindrical shell of the lock, the shell normally being retained inside the lock housing. FIG. 9B shows these components from an opposite side as compared to FIG. 9A.

DESCRIPTION OF PREFERRED EMBODIMENTS

Figure 1:
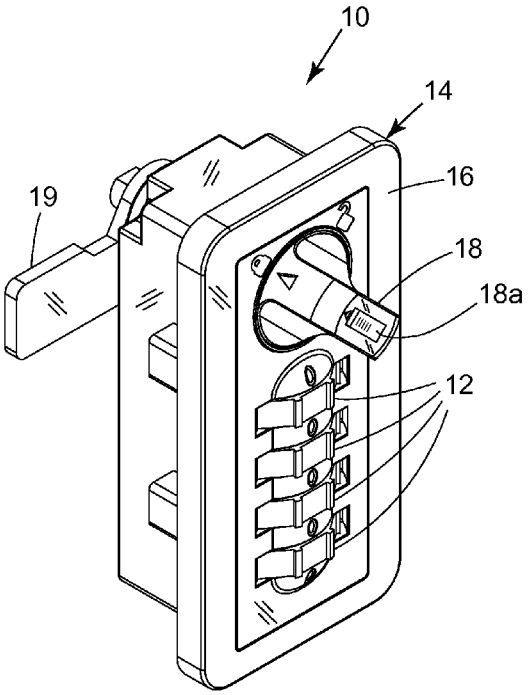
Figure 1 PRIOR ART
FIGS. 1 and 2 are perspective views showing a mechanical combination cam lock of the invention, with an override mechanical key slot through the handle. The views show the lock knob in locked and unlocked positions.
Figure 2:
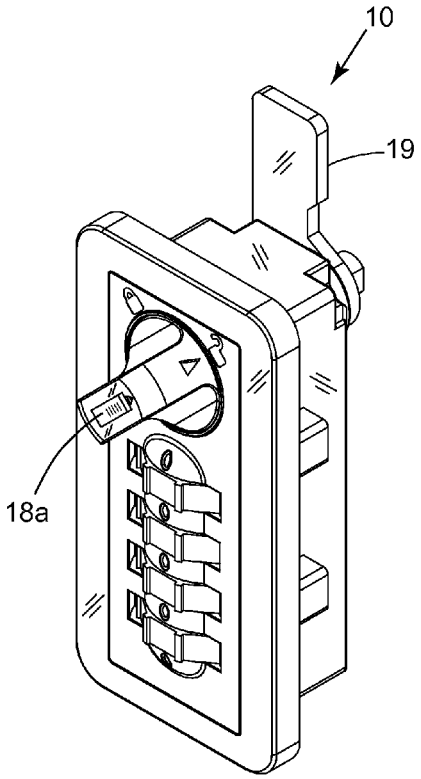
Figure 2 PRIOR ART

In the drawings, FIGS. 1 and 2 show a prior art mechanical combination lock having a mechanical key override. The lock 10 is shown here in the form of a cam lock of a type often applied to lockers for temporary storage of users' personal belongings, such as exercise facilities or stores or other workplaces. The lock has a common form of mechanical combination access device, i.e. a mechanical combination lock, that can comprise a set of digit selection dials 12 (four shown here), which are individually rotatable by a user to enter a combination of digits, the dials being mounted for rotation in a housing 14 having an exposed face plate 16, and a knob or handle 18 in the housing for rotating a cam 19 at rear to a locked position as in FIG. 1 or an unlocked position as in FIG. 2, as permitted by an internal mechanism controlled by the combination dials 12. As shown in the drawings, indicia for locked and unlocked positions can be included on the face plate.

Typically these types of combination lock 10 have an internal mechanism that permits a user to enter any selected combination of digits for temporary access. The user selects a locker with the lock in the unlocked position as shown in FIG. 2, then sets a desired personal combination on the digit dials and locks articles inside by rotating the knob 18 to the locked position, with the door closed, as shown in FIG. 1. The user's personal combination is the combination that will be needed to re-open the lock. Dial combination locks in this configuration can also be pre-set with a permanently assigned combination.

The locks 10 of the type described typically include a key slot 18*a* which extends through the knob or handle 18 into a rotatable key core or plug inside. This is for an override key held by the manager or owner, to override the combination lock and unlock the lock 10 to open the locker when a combination has been forgotten. Typically this override function is achieved by the lock having two rotatable elements on the same axis where the key is inserted: the plug itself (not shown in FIGS. 1-2), into which the mechanical key is inserted and which is connected to the cam 19; and a rotatable cylindrical sleeve or barrel (not shown) surrounding the plug. The barrel is prevented from rotation except when the proper combination of digits has been entered on the digit dials 12, or when the knob/plug is in the unlocked position as in FIG. 2. The core or plug, along with the handle 18, is normally engaged with the cylinder or barrel so that the two normally rotate together. Thus, in the locked configuration the combination mechanism has extended a blocking device, such as blocking pin, into a hole or slot in the barrel so as to prevent rotation of the barrel, and this prevents rotation of the knob 18. However, when an override key is inserted into the slot 18*a* and into the core or plug, the key cut combination pulls back pins or wafers of the plugs to a prescribed extent for each wafer, to allow the plug to rotate independently of the barrel, therefore allowing the rotation of the knob to move the cam to the unlocked position without rotating the barrel. After the override key is used, the combination lock can be reset; different manufacturers have different tools or methods to reset the combination lock so that it is set to the unlock condition.

A problem arises if this override key is lost. The lock 10 must be re-keyed, which can be more costly than replacement of the entire lock.

Figure 3:
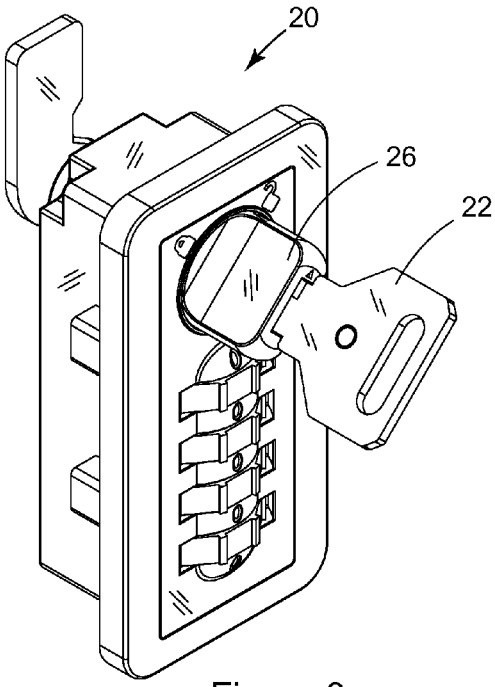
FIGS. 3 and 4 are perspective views of the lock, one showing an override mechanical key inserted into the override through the handle, and FIG. 4 showing a special removal key inserted through the handle into the lock.
Figure 4:
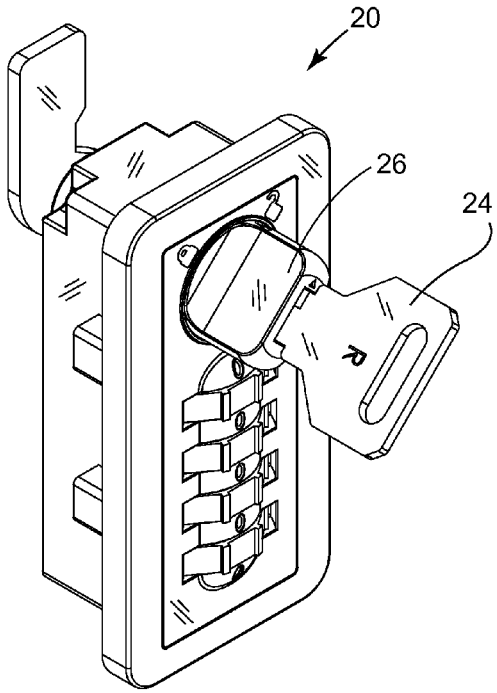
Figure 5:
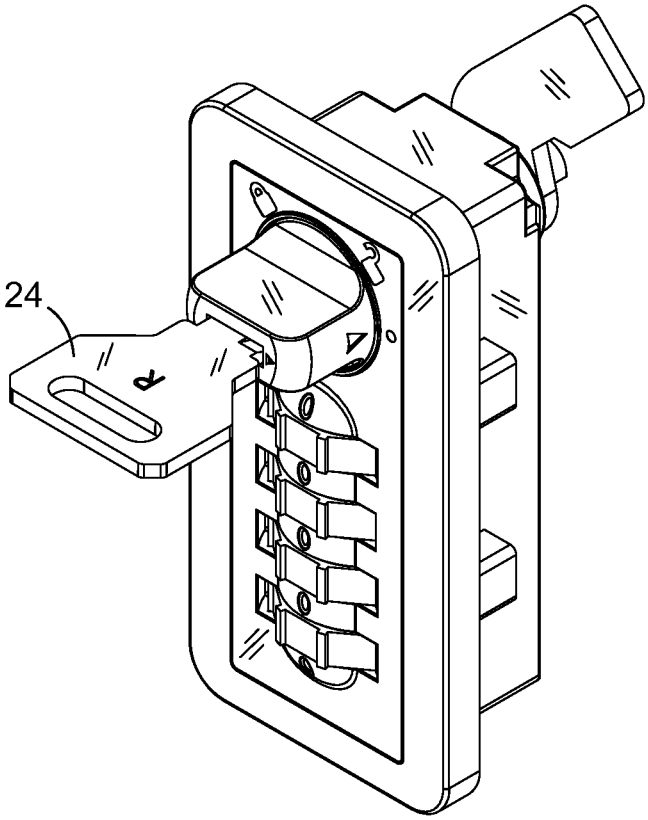
FIG. 5 is a view showing the removal key of FIG. 4 in the lock, but with the key and knob turned to a further, special position not otherwise accessible, the position at which the handle and core can be removed along with the key, for replacement.
Figure 6:
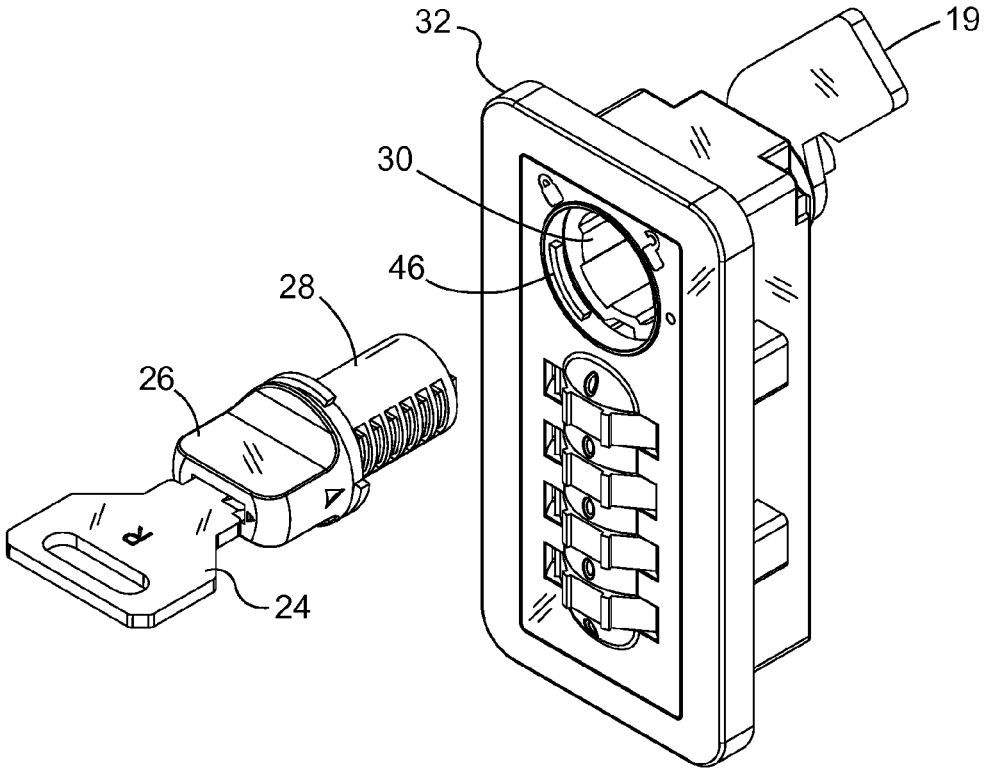
FIG. 6 is a perspective view that continues the progression shown in FIGS. 4 and 5. In this view the key, handle and core have been pulled out of the lock.

FIGS. 3 through 6 show the combination cam lock device 20 of the invention. The lock 20 is representative of the invention, but the principle of the invention applies to any form of combination lock. As shown in FIGS. 3-5, the lock 20 of the invention includes a mechanical override key 22 such as discussed above in connection with typical such locks shown in FIGS. 1 and 2. However, the invention also includes a removal key 24 by which the lock core and knob 26 can be removed, for replacement with a new core or plug. As explained above, the removal key 24 is effective not only to allow rotation of the handle and internal core from the locked to the unlocked position (which is shown in FIG. 4) but also to a further position shown in FIG. 5, which is core removal position. In FIG. 5 the removal key 24 has been used to rotate the knob and core beyond the unlocked position to a position (noted by indicia) that is not normally available. In this position, the core 28, as shown in FIG. 6, can be pulled out along with the knob 26 and the removal key 24. This leaves the cylinder or barrel 30 inside the lock housing 32. The barrel 30 is not removable and remains in the housing unless the lock is dismantled. The invention thus effects removal and replacement of a key core or plug simply and quickly without requiring dismantling of the lock. As discussed below, the knob 26 can be retained and attached to a new core or plug, which is then inserted into the lock. The key/knob/core is rotated to the unlocked position, and the lock is ready to be used.

The remaining drawing figures show details of a preferred embodiment of the invention.

Figure 7A:
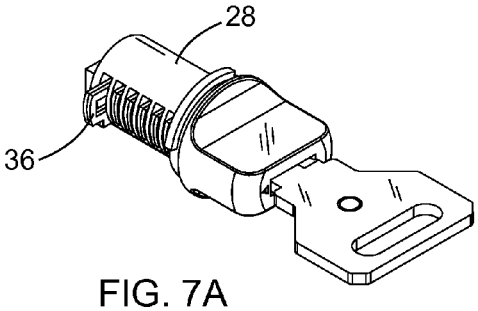
FIGS. 7A, 7B, 7C and 7D are perspective and plan views showing the key core and handle with the respective override and removal keys, and showing the keys themselves.
Figure 7C:
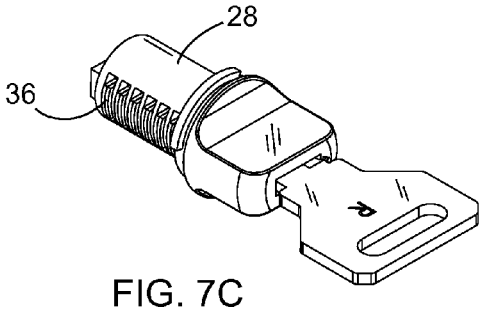
Figure 7B:
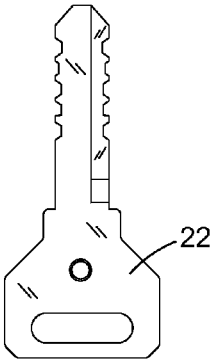
Figure 7D:
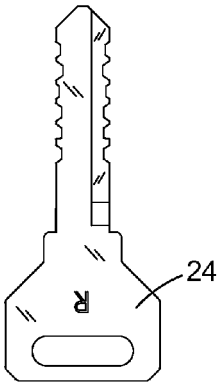

FIGS. 7A-7D show the key as well the key, knob and plug together for both the override key and the removal key for a lock of the invention. As shown in FIGS. 7B and 7D, the removal key 24 in this particular embodiment has a longer key blade than that of the override key 22. The regular override key 22 thus does not reach a last wafer 36, at a position deepest in the lock. That wafer 36 remains extended until the longer key blade of the removal key is inserted, the key 24 drawing in the wafer 36 as shown in FIG. 7C.

As long as the last wafer 36 is extended, it resides in a dedicated arcuate slot of the surrounding shell or barrel, fixing the core or plug with the barrel for rotation together. This is explained further below.

Figure 8A:
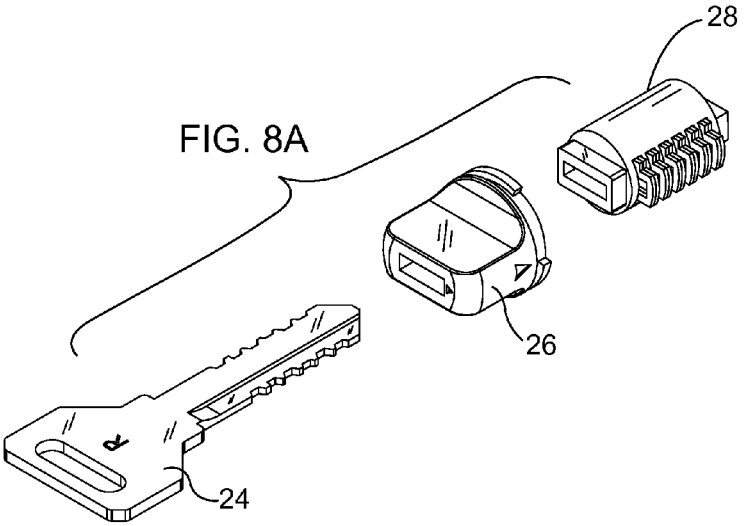
FIGS. 8A and 8B are exploded views in perspective indicating the removal key and its relation to the knob or handle and the mechanical lock core.
Figure 8B:
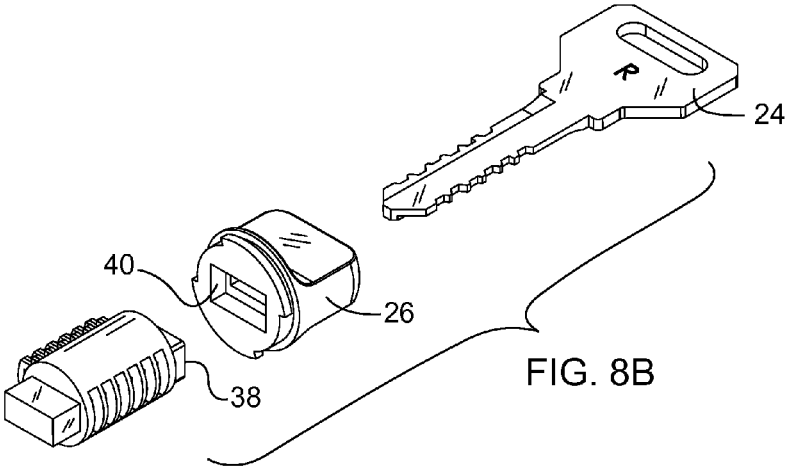

FIGS. 8A and 8B are perspective views from opposite directions, showing the removal key 24, the lock knob 26 and core or plug 28. The knob 26 attaches to the plug via an end boss 38 on the plug that fits closely into a recess 40 at the back end of the knob, the recess being shown rectangular. This simple boss-in-socket connection, which can be pulled apart after key/knob/core removal, is all that is required to connect the knob 26 to the core 28. In FIGS. 9A and 9B the knob 26 is again shown, in its relationship to the cylinder or barrel 30

(which always remains in the lock housing). The plug 28 is shown within the barrel, and at the rear of the plug or core is a back end element 42 that engages with the cam 19 to rotate the cam whenever the plug rotates. These figures also show a retention feature 44 on the knob 26, which could take many different forms but in the illustrated form is simply a pair of arcuate and radially extending flanges 44 at the inner end of the knob, so that the knob must necessarily be rotated to the removal position, such as shown in FIG. 6, before it can be pulled out. FIG. 6 shows that cooperating arcuate ridges 46 (only one being visible) are included in the housing, at its front opening that receives the knob 26. Therefore, to remove the plug from the housing, not only must the removal key 24 be inserted but also the position of the knob must be rotated to the removal position.

Also seen in FIG. 9 is the rearmost wafer 36 of the plug, extending into an elongated arcuate slot 48 of the cylinder or barrel. This structure, also seen in FIGS. 11A and 11B discussed below, allows the plug to be rotated within the cylinder 30 for normal override key operation wherein the lock is to be opened without the dial combination being entered, but not permitting removal of the plug or knob.

Figure 10:
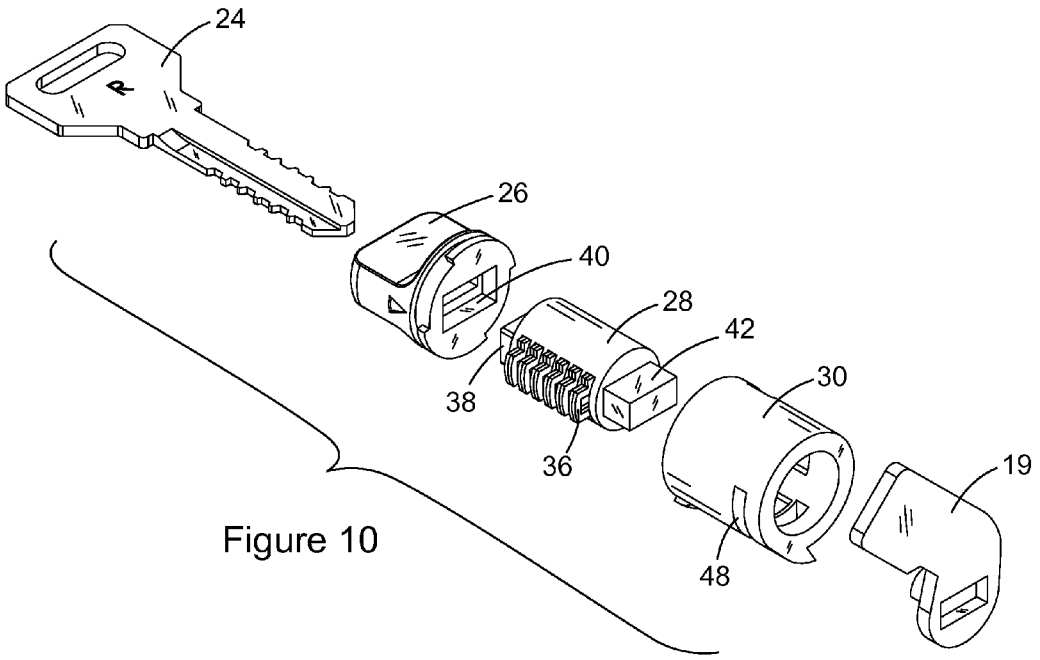
FIG. 10 is a perspective view showing the special removal key, lock knob, the core, rotatable cylinder and cam of the lock.

FIG. 10 shows the assembly of the cam 19, cylinder or barrel 30, plug 28, knob 26 and removal key 24. Again, this view schematically indicates the assembly, but the barrel 30 always remains within the lock housing. The slot 48 within which the last wafer 36 normally resides is better seen in this view.

Figure 11B:
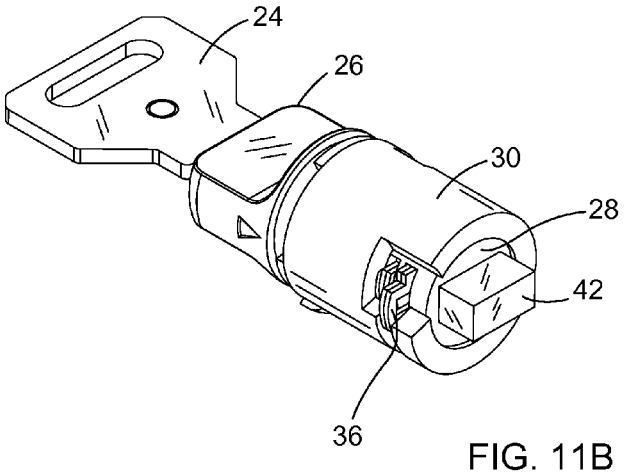
FIGS. 11A and 11B are perspective views showing the removal key inserted through the handle and into the lock core, and the regular override key similarly inserted. The rotatable cylinder of the combination lock, into which the core is fitted, is shown aside from the lock housing in these views but is actually not removable from the lock housing.
Figure 11A:
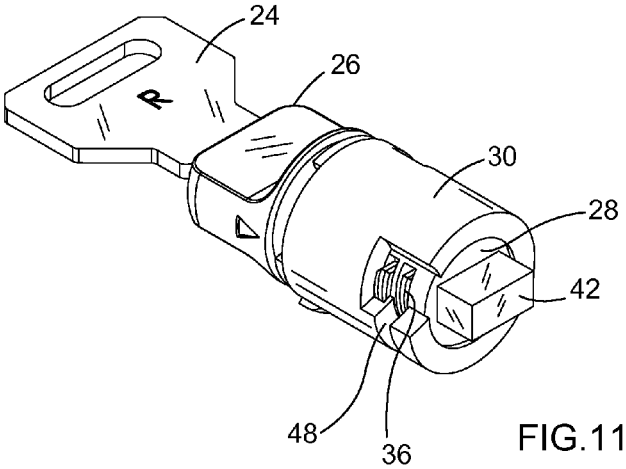

FIGS. 11A and 11B show the assembly of the removal key with knob, plug and barrel, alongside the override key in the same assembly. With the override key 22 (FIG. 11B), the last wafer 36 is unaffected and remains extended so that the plug cannot be pulled out from the barrel 30. FIG. 11A shows that when the removal key 24 is inserted, the longer key blade reaches the last wafer 36 and retracts it so that, with the knob correctly rotated to the removable position (FIG. 6), the assembly of the key, knob and plug can be pulled out and removed from the barrel 30 and from the housing. Note that adjacent to the elongated slot 48 in FIGS. 11A and 11B, some structure of the barrel is cut away for better viewing of the plug with its other wafers, which interact with internal structure of the barrel for the regular override function.

Other release structures can be used rather than the greater length of the removal key in the described embodiment. For example, a special release tool with specific or non-specific cross section could be inserted into a slot or bore or channel in the housing or through the knob for this purpose, to release an element that normally keeps the plug retained in the barrel. This could be a simple pin pushed through a bore to a position adjacent to the back end of the plug, such that rotation of the plug with the mechanical key from one position to another will cause a camming action against the pin to retract a retention wafer thus allowing the plug to be pulled out and removed. Another example is a removal key with a dimple, not present on the normal override key, that effects release of the core. The invention also applies to other types of mechanical combination locks.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

We claim:

1. A combination cam lock with a mechanical override key that enables override of a mechanical combination access device of the lock, comprising:

a cam lock housing suitable for mounting in a locker door or other openable panel, said mechanical combination access device being at the front of the housing, with means for entry of a specific number combination by a user for normally accessing the lock, a rotatable knob or handle on the lock housing, with rotation permitted when a proper number combination has been entered using the mechanical combination access device, the rotation of the knob or handle being effective to rotate a cam at rear of the housing to open the lock, the knob or handle having a key slot for receiving a key extended through the key slot, and with a core or plug inside the lock, behind the knob or handle and engaged with the knob or handle at an inner side of the key slot and positioned to receive the key, so as to permit rotation of the knob or handle and core or plug using the override mechanical key, thus to rotate the cam and gain access, the core or plug having means for permitting rotation of the knob or handle to a removing position, only when a special mechanical key or device is inserted into the lock, enabling the core or plug with the knob or handle to be pulled out and removed, and means connecting the knob or handle to the core or plug so as to be capable of disengaging the knob or handle from the core or plug when removed, for attachment of the knob or handle to a replacement core or plug.

2. The combination cam lock of claim 1, wherein the means for permitting rotation of the knob or handle to a removing position comprises a special pin or wafer in the core or plug which is normally extended to a position preventing removal of the core or plug from the lock, and wherein the special mechanical key or device is a removal key having greater length than the override mechanical key, the greater length being effective to retract the special pin or wafer to allow the removal key, knob or handle and core or plug to be pulled out from the lock.

3. The combination cam lock of claim 2, wherein the combination lock includes a cylindrical barrel surrounding the core or plug, the barrel normally being fixed to the core or plug and rotatable with the core or plug and knob or handle, and the barrel being rotatable within the lock housing only when a correct combination has been entered into the mechanical combination access device, the cam at the rear of the lock being connected to and rotatable with the back end of the core or plug, whereby in normal operation the knob or handle is permitted rotation to turn the cam and gain access when a proper combination is entered in the combination access device, so that the knob or handle, core or plug and cylindrical barrel are turned together; and whereby when the lock is in locked condition via the mechanical combination device, the override mechanical key can rotate the core or plug independent of the cylindrical barrel to move the cam to unlocked position; and whereby the override mechanical key can be replaced with a different key by use of the removal key, which acts as an override key and further permits rotation of the knob or handle to the removing position so that the knob or handle and core or plug can be removed from the lock and separated to permit replacement of the override key and core or plug with different keying.

4. A combination cam lock with a mechanical override key that enables override of a mechanical combination access device of the lock, comprising:

a cam lock housing suitable for mounting in a locker door or other openable panel, said mechanical combination access device being at the front of the housing, with means for entry of a specific number combination by a user for normally accessing the lock, a rotatable knob or handle on the lock housing, with rotation permitted when a proper number combination has been entered using the mechanical combination access device, the rotation of the knob or handle being effective to open the lock, an override mechanical key, the knob or handle having a key slot for receiving a key extended through the key slot, and with a core or plug inside the lock, behind the knob or handle and engaged with the knob or handle at an inner side of the key slot and positioned to receive the key, so as to permit rotation of the knob or handle and core or plug using the override mechanical key, thus to rotate a cam and gain access, the core or plug including removal means for enabling retraction and removal of the core or plug on the insertion of a mechanical release device, and means connecting the knob or handle to the core or plug so as to be capable of disengaging the knob or handle from the core or plug when removed, for attachment of the knob or handle to a replacement core or plug.

* * * * *